US009287605B2

(12) United States Patent
Daughenbaugh, Jr. et al.

(10) Patent No.: US 9,287,605 B2
(45) Date of Patent: Mar. 15, 2016

(54) PASSIVE COAXIAL POWER SPLITTER/COMBINER

(71) Applicant: TRIQUINT CW, INC., Hillsboro, OR (US)

(72) Inventors: Paul Daughenbaugh, Jr., Newbury Park, CA (US); Scott Behan, Somis, CA (US); Patrick Courtney, Newbury Park, CA (US)

(73) Assignee: TriQuint CW, Inc., Hillsboro, OR (US)

( * ) Notice: Subject to any disclaimer, the term of this patent is extended or adjusted under 35 U.S.C. 154(b) by 184 days.

(21) Appl. No.: 13/719,167

(22) Filed: Dec. 18, 2012

(65) Prior Publication Data

US 2014/0167880 A1 Jun. 19, 2014

(51) Int. Cl.

| | |
|---|---|
| ***H01P 3/08*** | (2006.01) |
| ***H01P 5/12*** | (2006.01) |
| ***H01Q 13/08*** | (2006.01) |

(52) U.S. Cl.
CPC . *H01P 5/12* (2013.01); *H01Q 13/08* (2013.01)

(58) Field of Classification Search
CPC ..... H01P 5/12; H03H 7/46; H01Q 13/08
USPC ..... 333/127, 136, 124–126
See application file for complete search history.

(56) References Cited

U.S. PATENT DOCUMENTS

| | | | | |
|---|---|---|---|---|
| 4,283,685 | A | | 8/1981 | MacMaster et al. |
| 4,291,278 | A | | 9/1981 | Quine |
| 4,302,734 | A | * | 11/1981 | Frosch et al. ..... 333/104 |
| 4,424,496 | A | | 1/1984 | Nichols et al. |
| 4,588,962 | A | | 5/1986 | Saito et al. |
| 4,782,346 | A | | 11/1988 | Sharma |
| 4,925,024 | A | | 5/1990 | Ellenberger et al. |
| 5,057,908 | A | | 10/1991 | Weber |
| 5,142,253 | A | * | 8/1992 | Mallavarpu et al. ..... 333/127 |
| 5,214,394 | A | | 5/1993 | Wong |
| 5,256,988 | A | | 10/1993 | Izadian |
| 5,600,286 | A | | 2/1997 | Livingston et al. |
| 5,736,908 | A | | 4/1998 | Alexanian et al. |
| 5,920,240 | A | | 7/1999 | Alexanian et al. |
| 6,028,483 | A | | 2/2000 | Shealy et al. |
| 6,157,076 | A | | 12/2000 | Azotea et al. |
| 6,384,691 | B1 | | 5/2002 | Sokolov |
| 6,686,875 | B1 | | 2/2004 | Wolfson et al. |

(Continued)

OTHER PUBLICATIONS

Notice of Allowance for U.S. Appl. No. 13/685,658, mailed Aug. 3, 2015, 7 pages.

(Continued)

*Primary Examiner* — Robert Pascal
*Assistant Examiner* — Kimberly Glenn
(74) *Attorney, Agent, or Firm* — Withrow & Terranova, P.L.L.C.

(57) ABSTRACT

A passive coaxial signal power splitter apparatus includes an input port, an input coaxial waveguide section coupled to the input port, a guided wave structure coupled to the input coaxial waveguide section, a plurality of antenna elements arranged in the guided wave structure, and an output port coupled to each of the antenna elements. A passive coaxial signal power combiner includes a plurality of input ports, a guided wave structure coupled to the plurality of input ports, a plurality of antenna elements in the guided wave structure, wherein each antenna element is coupled to one or more of the input ports, a coaxial waveguide section coupled to the guided wave structure, and an output port coupled to the coaxial waveguide section.

18 Claims, 6 Drawing Sheets

(56) References Cited

U.S. PATENT DOCUMENTS

| | | | | |
|---|---|---|---|---|
| 7,215,220 | B1 | 5/2007 | Jia | |
| 7,385,462 | B1 * | 6/2008 | Epp et al. | 333/125 |
| 7,482,894 | B2 * | 1/2009 | Wu et al. | 333/137 |
| 2008/0211726 | A1 | 9/2008 | Elsallal et al. | |
| 2013/0127678 | A1 | 5/2013 | Chandler | |
| 2014/0145794 | A1 | 5/2014 | Courtney et al. | |
| 2014/0145795 | A1 | 5/2014 | Behan et al. | |

OTHER PUBLICATIONS

Abdulla, Mostafa N. et al., "A Full-Wave System Simulation of a Folded Slot-Spatial Power Combining Amplifier Array," 1999 IEEE MTT-S Digest, vol. 2, Jun. 1999, pp. 559-562.
Acharya, Pransy R. et al., "Tapered Slotline Antennas at 802 GHz," IEEE Transactions on Microwave Theory and Techniques, vol. 41, No. 10, Oct. 1993, pp. 1715-1719.
Alexanian, A. et al., "Broadband Spatially Combined Amplifier Array Using Tapered Slot Transitions in Waveguide," IEEE Microwave and Guided Wave Letters, vol. 7, No. 2, Feb. 1997, pp. 42-44.
Alexanian, Angelos et al., "Broadband Waveguide-Based Spatial Combiners," 1997 IEEE MTT-S Digest, vol. 3, Jun. 1997, pp. 1139-1142.
Alexanian, Angelos, "Planar and Distributed Spatial Power Combiners," Dissertation, Jun. 1997, 119 pages.
Chen, Lee-Yin V. et al., "Development of K-Band Spatial Combiner using Active Array Modules in an Oversized Rectangular Waveguide," Microwave Symposium Digest, 2000 IEEE MTT-S International, vol. 2, Jun. 2000, pp. 821-824.
Chen, Lee-Yin Victoria, "K-Band Spatial Combiner using Active Array Modules in an Oversized Rectangular Waveguide," Dissertation, Jun. 2003, 118 pages.
Chen, Lee-Yin V. et al., "K-band Spatial Combiner using Finline Arrays in Oversized Rectangular Waveguide," Proceedings of APMC2001, Taipei, Taiwan, R.O.C., 2001, pp. 807-810.
Cheng, Nai-Shuo et al., "20 Watt Spatial Power Combiner in Waveguide," 1998 IEEE MTT-S Digest, vol. 3, Jun. 1998, pp. 1457-1460.
Cheng, Nai-Shuo et al., "40-W CW Broad-Band Spatial Power Combiner Using Dense Finline Arrays," IEEE Transactions on Microwave Theory and Techniques, vol. 47, No. 7, Jul. 1999, pp. 1070-1076.
Cheng, Nai-Shuo et al., "Analysis and Design of Tapered Finline Arrays for Spatial Power Combining," Antennas and Propagation Society International Symposium, 1998 IEEE, vol. 1, 1998, pp. 466-469.
Cheng, Nai-Shuo et al., "Waveguide-Based Spatial Power Combining," 1998 National Radio Science Meeting, May 23, 1995, Form Version: 1.0, 1 page.
Cheng, Nai-Shuo, "Waveguide-Based Spatial Power Combiners," Dissertation, Aug. 1999, 107 pages.
Cheng, N.S. et al., "A 120-Watt X-Band Spatially Combined Solid-State Amplifier," IEEE Transactions on Microwave Theory and Techniques, vol. 47, No. 12, Dec. 1999, pp. 2557-2561.
Delisio, Michael P. et al., "Quasi-Optical and Spatial Power Combining," IEEE Transactions on Microwave Theory and Techniques, vol. 50, No. 3, Mar. 2002, pp. 929-936.
Harvey, J. et al., "Spatial Power Combining for High-Power Transmitters," IEEE Microwave, Dec. 2000, pp. 48-59.
Janaswamy, Ramakrishna et al., "Analysis of the Tapered Sloth Antenna," IEEE Transactions on Antennas and Propagation, vol. AP-35, No. 9, Sep. 1987, pp. 1058-1062.
Jeong, Jinho et al., "1.6- and 3.3W Power-Amplifier Modules at 24 GHz Using Waveguide-Based Power-Combining Structures," IEEE Transactions on Microwave Theory and Technique, vol. 48, No. 12, Dec. 2000, pp. 2700-2708.
Jeong, Jinho et al., "A 1.6 W Power Amplifier Module at 24 GHz Using New Waveguide-Based Power Combining Structures," Microwave Symposium Digest, 2000 IEEE MTT-S International, Jun. 2000, pp. 817-820.
Jia, Pengcheng, "A 2 to 20 GHz High Power Amplifier Using Spatial Power Combining Techniques," Microwave Journal, Apr. 2005, 4 pages.
Jia, Pengcheng et al., "A Compact Coaxial Waveguide Combiner Design for Ultra-Broadband Power Amplifiers," Microwave Symposium Digest, IEEE MTT-S 2001, vol. 1, May 2001, 4 pages.
Jia, Pengcheng et al., "Analysis of a Passive Spatial Combiner Using Tapered Slotline Array in Oversized Coaxial Waveguide," Microwave Symposium Digest, 2000 IEEE MTT-S International, vol. 3, Jun. 2000, pp. 1933-1936.
Jia, Pengcheng, "Broadband High Power Amplifiers Using Spatial Power Combing [sic] Technique," Dissertation, Dec. 2002, 151 pages.
Jia, Pengcheng et al., "BroadBand High Power Amplifier Using Spatial Power-Combining Technique," 2003 IEEE MTT-S Digest, 2003, pp. 1871-1874.
Jia, Pengcheng et al., "Broad-Band High-Power Amplifier Using Spatial Power-Combining Technique," IEEE Transactions on Microwave Theory and Techniques, vol. 51, No. 12, Dec. 2003, pp. 2469-2475.
Jia, Pengcheng et al., "Design of Waveguide Finline Arrays for Spatial Power Combining," IEEE Transactions on Microwave Theory and Techniques, vol. 49, No. 4, Apr. 2001, pp. 609-614.
Jia, Pengcheng et al., "Multioctave Spatial Power Combining in Oversized Coaxial Waveguide," IEEE Transactions on Microwave Theory and Techniques, vol. 50, No. 5, May 2002, pp. 1355-1360.
Liao, P. et al., "A 1 Watt X-Band Power Coupling Array Using Coupled VCOs," 1994 IEEE MTT-S Digest, vol. 2, May 1994, pp. 1235-1238.
Mottonen, Ville S., "Wideband Coplanar Waveguide-to-Rectangular Waveguide Transition Using Fin-Line Taper," IEEE Microwave and Wireless Components Letters, vol. 15, No. 2, Feb. 2005, pp. 119-121.
Rutledge, Daved B. et al.,"Failures in Power-Combining Arrays," IEEE Transactions on Microwave Theory and Techniques, vol. 47, No. 7, Jul. 1999, pp. 1077-1082.
Sabet, Kazem F. et al., "Fast Simulation of Large-Scale Planar Circuits Using an Object-Oriented Sparse Solver," 1999 IEEE MTT-S Digest, vol. 1, Jun. 1999, pp. 373-376.
Simons, Rainee N. et al., "Space Power Amplification with Active Linearly Tapered Slot Antenna Array," 1993 IEEE MTT-S Digest, vol. 2, Jun. 1993, pp. 623-626.
Simons, R. N. et al., "Non-Planar Linearly Tapered Slot Antenna with Balanced Microstrip Feed," Antennas and Propagation Society International Symposium, 1992, AP-S, 1992 Digest, IEEE, vol. 4, Jul. 1992, pp. 2109-2112.
York, Robert A. et al., "Coupled-Oscillator Arrays for Millimeter-Wave Power-Combining and Mode-Locking," 1992 IEEE MTT-S Digest, vol. 1, Jun. 1992, pp. 429-432.
York, Robert A. et al., "Quasi-Optical Power Combining Using Mutually Synchronized Oscillator Arrays," IEEE Transactions on Microwave Theory and Techniques, vol. 39, No. 6, Jun. 1991, pp. 1000-1009.
York, Robert A., "Some Considerations for Optimal Efficiency and Low Noise in Large Power Combiners," IEEE Transactions on Microwave Theory and Techniques, vol. 49, No. 8, Aug. 2001, pp. 1477-1482.
Non-Final Office Action for U.S. Appl. No. 10/925,330, mailed Dec. 5, 2005, 9 pages.
Non-Final Office Action for U.S. Appl. No. 10/925,330, mailed Jun. 14, 2006, 6 pages.
Quayle Action for U.S. Appl. No. 10/925,330, mailed Oct. 20, 2006, 5 pages.
Notice of Allowance for U.S. Appl. No. 10/925,330, mailed Feb. 12, 2007, 7 pages.
Non-Final Office Action for U.S. Appl. No. 13/685,658, mailed Sep. 24, 2014, 7 pages.
Final Office Action for U.S. Appl. No. 13/685,658, mailed Apr. 20, 2015, 7 pages.
Non-Final Office Action for U.S. Appl. No. 13/685,661, mailed Sep. 25, 2014, 8 pages.
Non-Final Office Action for U.S. Appl. No. 13/685,661, mailed Apr. 21, 2015, 8 pages.
Notice of Allowance for U.S. Appl. No. 13/685,658, mailed Nov. 10, 2015, 7 pages.
Notice of Allowance for U.S. Appl. No. 13/685,661, mailed Oct. 23, 2015, 8 pages.

* cited by examiner

PASSIVE COAXIAL POWER SPLITTER/COMBINER

FIELD

The invention relates to a device for spatially dividing power of an EM wave. More particularly, the invention relates to a device for passively dividing the EM wave among antenna elements provided within a coaxial waveguide cavity, and coupling each antenna to an output port.

BACKGROUND

The traveling wave tube amplifier (TWTA) has become a key element in broadband microwave power amplification for radar and satellite communication. One advantage of the TWTA is the very high output power it provides. However, there sometimes exists a requirement for passive splitting of the power for distribution to multiple outputs, either before or after amplification, where the bandwidth covers about a decade of frequency range, such as 2 to 20 GHz. Conversely, there sometimes exists a requirement for passive combining of multiple power streams into a single output, where the passive combiner can operate over a bandwidth that covers about a decade of frequency range, such as 2 to 20 GHz.

SUMMARY

In an embodiment of the invention, a passive coaxial signal power splitter apparatus includes an input port, an input coaxial waveguide section coupled to the input port, a guided wave structure coupled to the input coaxial waveguide section, a plurality of antenna elements arranged in the guided wave structure, and an output port coupled to each of the antenna elements.

In a further embodiment of the invention, a method of splitting a signal power in a passive coaxial apparatus includes inputting an electrical signal to an input port of the apparatus, transforming the signal to an electromagnetic (EM) wave propagating in a coaxial input waveguide section, coupling the EM wave into a coaxial guided wave structure comprising a plurality of antenna elements, and coupling the EM wave into a plurality of output ports operative coupled to the antenna elements.

In a further embodiment of the disclosure, a passive coaxial signal power combiner includes a plurality of input ports, a guided wave structure coupled to the plurality of input ports, a plurality of antenna elements in the guided wave structure, wherein each antenna element is coupled to one or more of the input ports, a coaxial waveguide section coupled to the guided wave structure, and an output port coupled to the coaxial waveguide section.

In a further embodiment of the disclosure, a method of combining a plurality of signals in a passive coaxial apparatus includes inputting each of a plurality of electrical signals to a corresponding one of a plurality of input ports, coupling the input ports to a guided wave structure, coupling each signal to a corresponding one of a plurality of antenna elements arranged in the guided wave structure, transforming with the antenna elements each signal to a corresponding electromagnetic (EM) wave propagating parallel to a longitudinal axis in the guided wave structure, coupling each corresponding EM wave to propagate in a coaxial waveguide section, wherein the coaxial waveguide section is coupled to the guided wave structure, and coupling the plurality of corresponding EM waves propagating in the coaxial waveguide section to an output port of the apparatus as a single electrical output signal.

BRIEF DESCRIPTION OF THE DRAWINGS

Many advantages of the present invention will be apparent to those skilled in the art with a reading of this specification in conjunction with the attached drawings, wherein like reference numerals are applied to like elements, and wherein.

DETAILED DESCRIPTION

The detailed description set forth below in connection with the accompanying drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

In accordance with the invention, a passive broadband spatial power splitting device has an input port, an input waveguide section, a coaxial waveguide section, and a plurality of output ports. The coaxial waveguide section is provided with longitudinally parallel, stacked wedge shaped trays. Antenna elements are mounted on each tray. When the trays are stacked together to form a coaxial waveguide, the antenna elements are disposed into the waveguide and form a dividing array at the input. With the use of antenna elements inside the coaxial waveguide for power dividing, a broadband frequency response may be achieved over a decade or more. For example, a range of about 2 to 20 GHz, or 4 to 40 GHz, may be realized to provide a portion of the input signal at each of the output ports. The antenna element is easy to manufacture using conventional printed circuit board (PCB) processes. Further, the division of a coaxial waveguide into wedge-shaped trays provides good thermal management, if required.

Figure 1A:
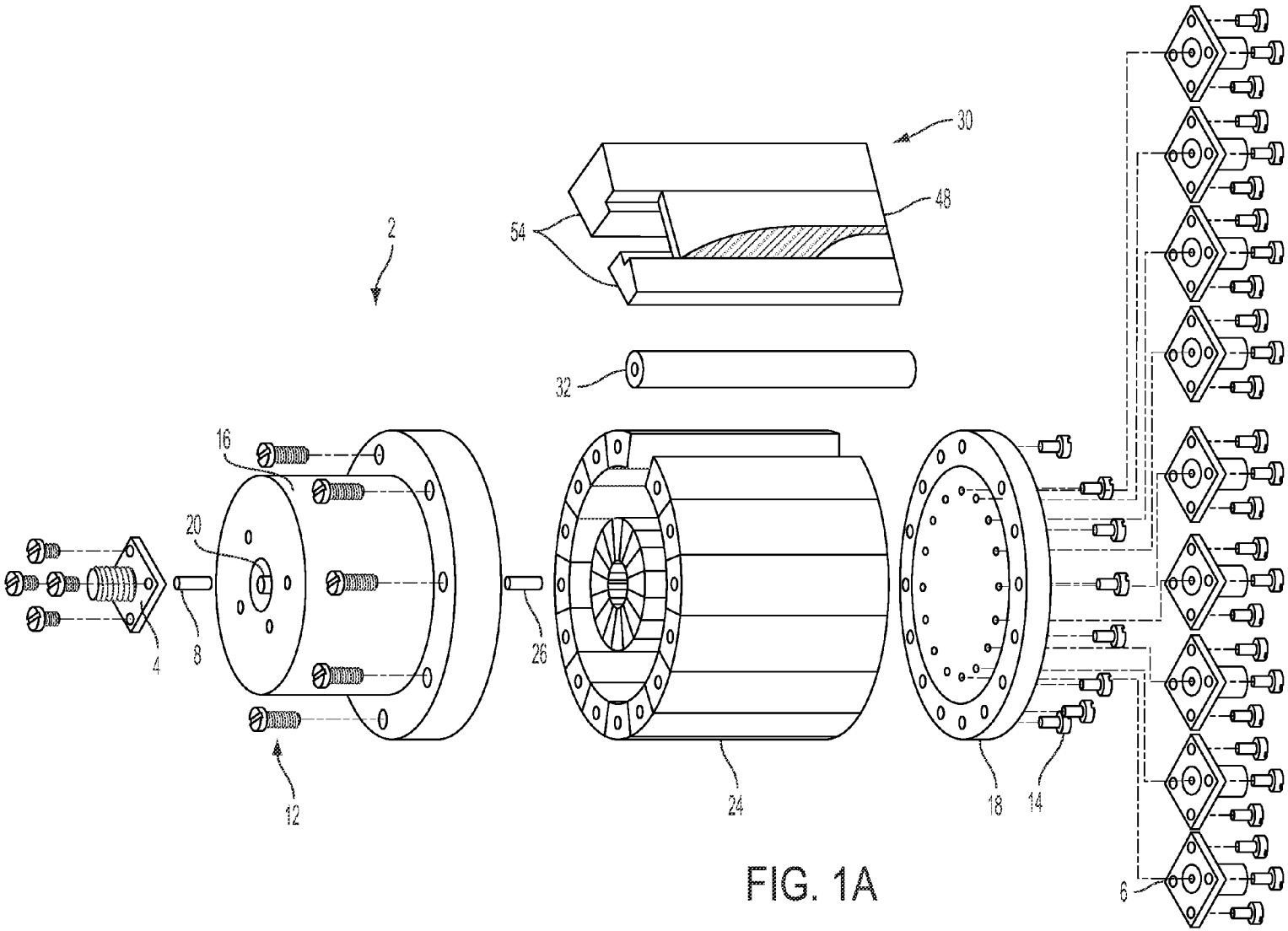
FIG. 1A is a perspective view of an embodiment of a power combining system in accordance with the invention.

As illustrated in FIG. 1A, in the passive coaxial spatial power splitting device 2 of the invention, an electromagnetic (EM) wave is launched from an input port 4 to an input coaxial waveguide section 12. The EM wave is divided up using a plurality of antennas 48. One or more output ports 6 may be connected at an opposite end of each antenna 48, according to the design of the antenna 48. The input waveguide section 12 provides a broadband transition from the input port 4 to a coaxial waveguide section 24. The outer surfaces of inner conductor 20 and the inner surface of outer conductor 16 all have gradually changed profiles. The profiles may be determined to control or minimize the impedance mismatch from the input/output ports 4 and 6 to the coaxial waveguide section 24. In the example illustrated in FIG. 1A, the coaxial spatial power splitting device 2 has one input port 4 arranged at one end of the input waveguide section 12 and a plurality of output ports 6 arranged on a splitter plate 18 coupled to an end of the coaxial waveguide section 24 opposite the input waveguide section 12 by means of a plurality of screws 14.

Figure 1B:
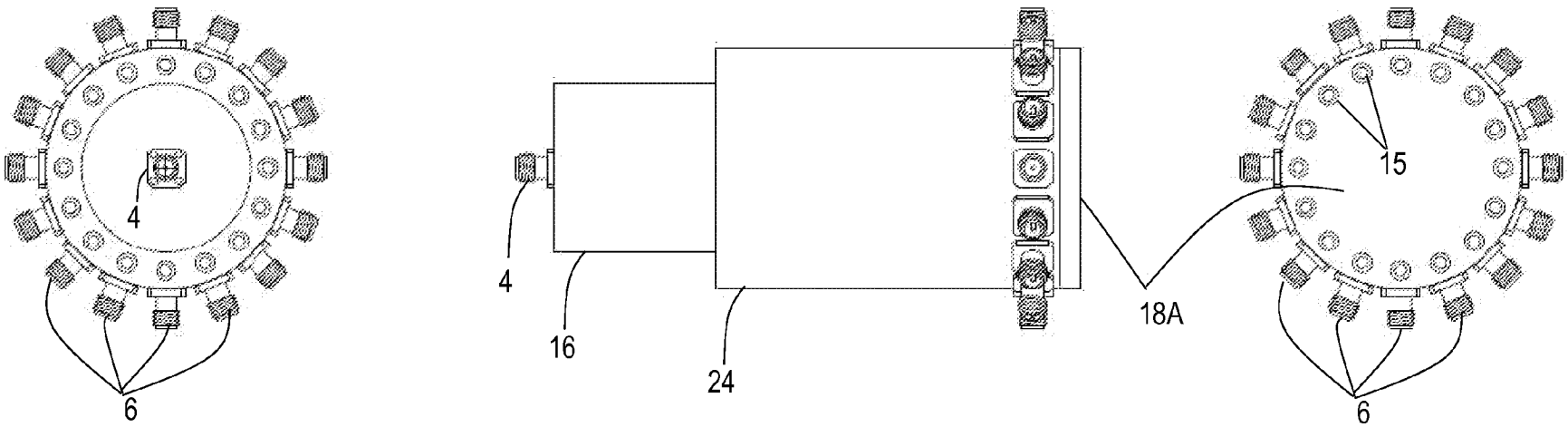
FIG. 1B illustrates three plan views of a second embodiment of a power combining system in accordance with the invention.

In an embodiment, referring to FIG. 1B, the a plurality of output ports 6 may be circumferentially arranged on the outer surface of the coaxial waveguide section 24 instead of on the splitter plate 18. In this example, each of the output ports 6 is coupled to a single antenna element 48. The output ports 6, as shown in this example are oriented radially, i.e., each output port 6 is substantially perpendicular to the longitudinal axis of the input waveguide section 16 and the coaxial waveguide section 24. The splitter plate 18 is replaced by a blank endplate 18A with a plurality of holes 15, to affix the endplate 18A to the coaxial waveguide section 24 with screws 14, as described above.

In an embodiment, the outer surface of inner conductor 20 and the inner surface of the outer conductor 16 have profiles adapted to obtain a transformation of waveguide impedance, if desired.

In a preferred embodiment, the input/output ports 4 and 6 are field replaceable SMA (Subminiature A) connectors, however, other types of connectors may be used. The flanges of the input/output ports 4 and 6 are screwed to the outer conductors 16 and splitter plate 18, respectively, with four screws each, although that number is not crucial, and other types of fasteners may be used. Pin 8 is used to connect between centers of the input port 4 and inner conductors 20. In other embodiments, the input/output ports 4 and 6 may be super SMA connectors, type N connectors, K connectors or any other suitable connectors. The pin 8 can also be omitted, if the input/output ports 4 and 6 already have center pins that can be mounted into inner conductor 20.

The coaxial waveguide section 24 comprises a plurality of trays 30 and a cylinder post 32 whose major longitudinal axis is coincident with a central longitudinal axis of the coaxial waveguide section 24. The plurality of trays 30 are stacked and aligned circumferentially around the post 32. Each tray 30 includes a carrier 54 (FIG. 2) having a predetermined wedge angle a (FIG. 3), an arcuate inner surface 36 conforming to the outer shape of post 32, and arcuate outer surface 34. When the trays 30 are assembled together, they form a cylinder with a cylindrical central cavity defined by inner surfaces 36 which accommodates the post 32. Post 32 connects with inner conductor 20 of input waveguide section 12 by way of screw 26. Post 32 is provided for simplifying mechanical connections, and may have other than a cylindrical shape, or be omitted altogether.

Figure 2:
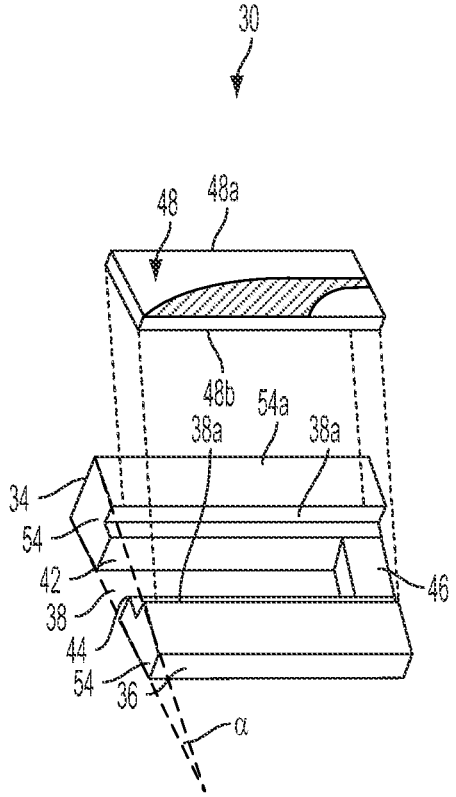
FIG. 2 is perspective view of a wedge shaped tray in accordance with the invention.

As detailed in FIG. 2, each tray 30 also includes an antenna (or "antenna element") 48 and a carrier 54. The carrier 54 has an input cut-out region 38 separating inner and outer portions which are connected by a bridge 46. Opposing major surfaces 42 and 44 of the regions 38 are arcuate in shape. When the trays 30 are stacked together, the region 38 forms a coaxial waveguide opening defined by circular outer and inner surfaces corresponding to arcuate major surfaces 42 and 44, and the arrangement of the antennas 48 on carriers 54 is such that the antennas lie radially about the central longitudinal axis of coaxial waveguide section 24. Alternatively, major surfaces 42 and 44 can be planar, rather than arcuate, such that the coaxial waveguide opening, in cross-section, will be defined by polygonal outer and inner boundaries corresponding to planar major surfaces 42 and 44.

The top surface 54*a* of metal carrier 54 is provided with recessed edges 38*a* in the periphery of cut-out region 38, and is recessed in order to accommodate the edges of antenna 48. When in position in a first carrier 54, the back edges of antennas 48 rest in the corresponding recessed edges 38*a* of the carrier 54, and back faces 48*b* of the antennas 48 face cut-out regions 38 of that first tray. Contact between the back face 48*b* of antenna 48 and the corresponding recessed edge 38*a* of the carrier 54 provides grounding to the antenna 48.

Outer surface 34 of the carrier 54 may be arcuate in shape such that when assembled together, the trays 30 provide the coaxial waveguide section 24 with a substantially circular cross-sectional shape. It is contemplated that other outer surface shapes, such as planar shapes, can be used, in which case the outer cross-sectional shape of the center coaxial waveguide section 24 becomes polygonal. Further, as mentioned above, the carrier has a predetermined wedge angle $\alpha$, so that the total number of trays 30 in the coaxial waveguide section is given by $360/\alpha$, where $\alpha$ is expressed in degrees.

Figure 3A:
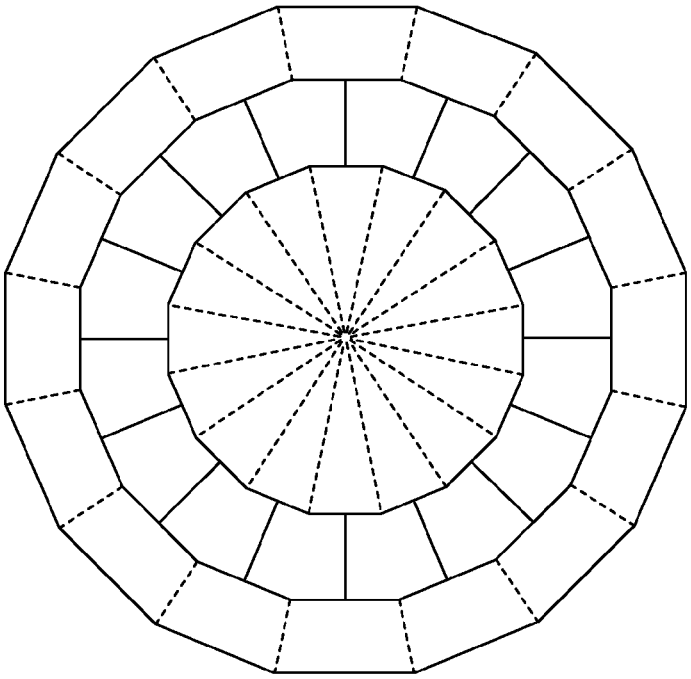
FIG. 3A is the cross section of a center waveguide structure which has a plurality of planar surfaces in accordance with the invention.

While it is preferred that the outside surfaces 34, 36 of each carrier 54, along with the inside surfaces 42, 44 of the cut-out regions all be arcuate in shape so as to provide for circular cross-sections, it is possible to use straight edges for some or all of these surfaces, or even other shapes instead, with the assembled product thereby approximating cylindrical shapes depending on how many trays 30 are used. FIG. 3A shows an embodiment in which a cross section of the coaxial waveguide section 24 shows that the outside surfaces and inside coaxial waveguide openings are all approximated by straight planes. A polygonal cross-sectional shape results, but if a sufficient number of trays are used, a circular cross section is approximated.

Figure 3B:
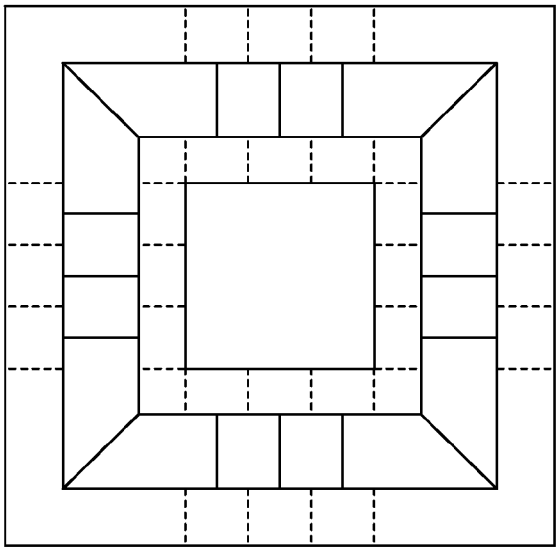
FIG. 3B is the cross section of center waveguide structure which has a rectangular outside profile and a rectangular coaxial waveguide opening in accordance with the invention.

In the preferred embodiment, the wedge shaped trays 30 are radially oriented when stacked together to form a circular coaxial waveguide, as seen schematically in FIG. 3A. However, the trays can have other shapes, which may be different from one another, and a non-cylindrical coaxial waveguide can thus result. FIG. 3B shows such an arrangement, resulting in a rectangular (square) coaxial waveguide. In FIGS. 3A and 3B, the bold solid radial lines represent the antenna structures. The dashed lines represent the inter-tray boundaries.

Figure 4:
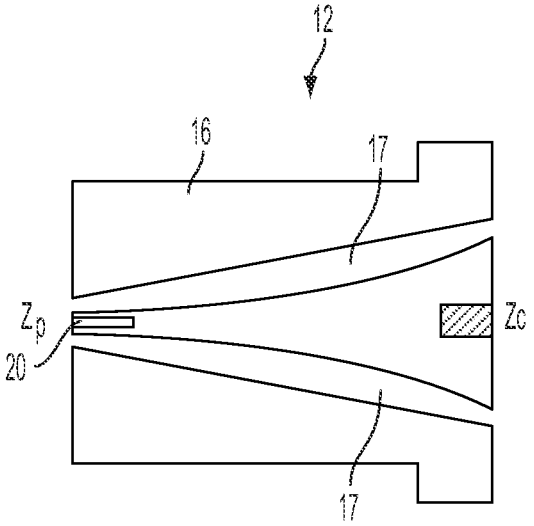
FIG. 4 is longitudinal cross sections of the input waveguide section in accordance with the invention.

FIG. 4 shows a longitudinal cross-sectional view of the input coaxial waveguide section 12. The waveguide section provides a smooth mechanical transition from a smaller input port 4 (at Zp) to a flared center section 17. Electrically, the waveguide section provides broadband impedance matching from the input port impedance Zp to the center section waveguide impedance Zc. The profiles of the inner conductors and outer conductors are determined by both optimum mechanical and electrical transition in a known fashion.

Figure 5:
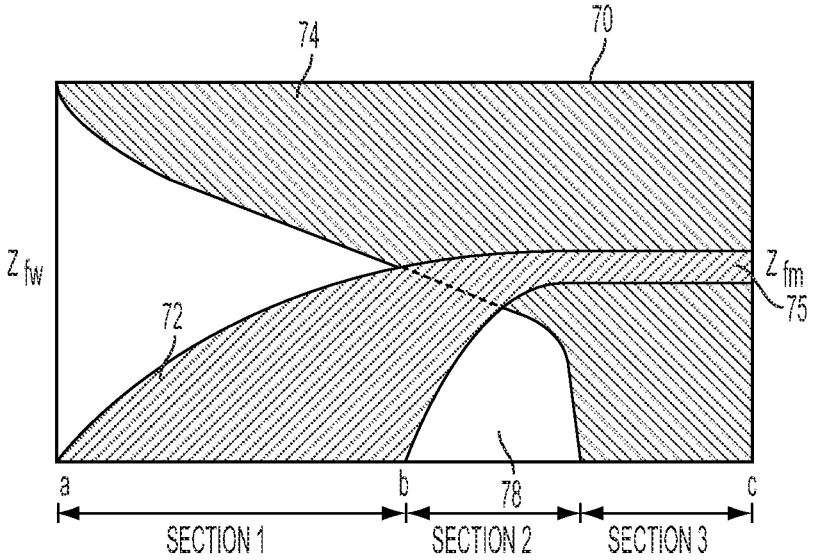
FIG. 5 is a view of an example of an antenna element in accordance with the invention.

Details of an example of an antenna 70 of the invention are disclosed. The example may be referred to as an antipodal finline structure, but other antenna designs are possible, and the description is intended for purposes of illustration without loss of generality. Referring to FIG. 5, three sections (section 1, between lines a and b, sections 2 and 3, between lines b and c), are delineated in the drawing figures for ease of explanation and discussed separately, with the understanding that these sections are not separate but are actually part of one unitary component. In Section 1, lying between lines a and b, top side (corresponding to side 48*a* of FIG. 2) metal conductor 72 and back side metal conductor 74 (corresponding to side 48*b* of FIG. 2) are shown to expand in area outward respectively from the lower and upper edges of the substrate 76. In Section 2, top side conductor 72 narrows to a strip 75, while back side conductor 74 expands to a wider ground that has substantially the same width as the substrate. Section 3 has a straight microstrip line on the top side, and a back side conductor as ground, forming a microstrip waveguide. This arrangement is easier to manufacture by eliminating a conventional balun as is know in the prior art, while still offering good compatibility with commercial off-the-shelf monolithic integrated circuits (COTS MMICs). The tapered 3-section antipodal finline is referred to herein as an antipodal finline taper. In a preferred embodiment, e.g., in the 2-20 GHz bandpass range, the overall length of an antipodal finline taper is about 2.4 inches. For other decade bandwidths, the preferred overall length may differ.

Figure 6A:
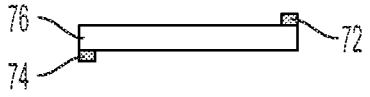
FIGS. 6A-6C show cross sections of the exemplary antenna element of FIG. 5 taken at various locations in accordance with the invention.
Figure 6B:
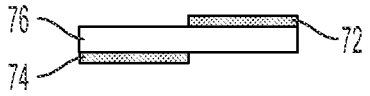
Figure 6C:
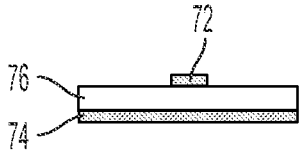

FIGS. 6A-6C show the cross sections of the antipodal finline taper taken along lines a, b and c. The top side conductor 72 and back side conductor 74 are preferably disposed on a soft PTFE based substrate 76. The substrate can also be any other suitable material, such as ceramic, or non-PTFE substrate. The cross sections of FIGS. 6A-6C show the gradual changes of the top and back side metal conductors from left side to the right side. The top side conductor 72 becomes wider first and then narrower as a microstrip line. The back side conductor 74 becomes wider, then a ground plane.

A profile of the conductive patterns of the top side conductor 72 and back side conductor 74 on the substrate 76 of the antenna 48 may be designed by well know principals, e.g., the theory of small reflections, to minimize reflection of the traveling EM wave. The profile of conductive patterns on the antenna 48 is judiciously chosen to avoid exciting multimode resonance at higher frequency (i.e., cutoff) and response deterioration at lower frequency. Other antenna patterns than that just described, and multi-layer antennas may be considered as well, including antennas that have more than two conductive layers.

As described above, with respect to the antipodal finline taper, the top side conductor 72 becomes wider first and then narrower as a microstrip line. The back side conductor 74 becomes wider, then a ground plane. In an embodiment, the microstrip line of each antenna 48 may couple to a center terminal of an output port 6 arranged in the splitter plate 18. Thus, the plurality of antennas 48 may each be adapted to couple a fraction of the total power input to the power splitting device 2 out through the output ports 6.

In an embodiment, an antenna may be designed to couple and transform power in the EM field into more than one microstrip line on the same substrate 76, thereby permitting power distribution to more than one output port 6 per antenna element. The ratio of power split into each output port 6 may be according to the arrangement of one or more different antenna designs. Thus, for example, if all antennas are identical and each terminating in a single microstrip, the power splitting ratio at each output port 6 may be approximately the input power divided by the number of output ports.

It should be appreciated that the power splitter 2 may be operated in reverse. That is, separate electrical signals may be applied to the output ports 6 as if they were input ports. The signal is transformed by the respective antenna 48 into an EM field traveling backward to the input waveguide section 12, which then feeds the signal to the input port 4. Thus, a plurality of electrical signals, which may each contain different information content, or occupy a different portion of the operational spectrum of the power splitter 2, may be combined into one composite signal at the port 4.

It may be further appreciated that the power splitter 2, whether operated in forward or reverse mode, may have an operational bandwidth up to, and greater than, a decade of frequency, such as, for example, 2 to 20 GHz, or 4 to 40 GHz, but not limited to these frequency ranges.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language of the claims, wherein reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A passive coaxial signal power splitter apparatus comprising:

an input port;

an input coaxial waveguide section coupled to the input port;

a guided wave structure coupled to the input coaxial waveguide section, wherein the guided wave structure is coaxially cylindrical having an inner radius and an outer radius;

a plurality of antenna elements arranged in a radial direction from the inner radius to the outer radius in the guided wave structure; and a plurality of output ports, wherein each output port is coupled to only one of the antenna elements.

2. The apparatus of claim 1, wherein the input port is arranged to launch an electromagnetic (EM) wave into the input coaxial waveguide, and wherein the input coaxial waveguide is arranged to couple the EM wave to the guided wave structure.

3. The apparatus of claim 2, wherein the input coaxial waveguide section is arranged to guide the EM wave having an electric field directed radially and propagating parallel to a longitudinal axis.

4. The apparatus of claim 1, wherein the plurality of antenna elements transform a radial EM field into a guided wave having a substantially circumferential direction of an electric field in each of the antenna elements.

5. The apparatus of claim 4, wherein each output port of the plurality of output ports is arranged in an output plate and is coupled to one of the antenna elements.

6. The apparatus of claim 4, wherein each output port of the plurality of output ports is arranged on an outer surface of the guided wave structure and is coupled to one of the antenna elements.

7. The apparatus of claim 6, wherein an axis of orientation of each output port of the plurality of output ports is substantially perpendicular to the longitudinal axis of the input waveguide section.

8. The apparatus of claim 1, wherein each antenna element of the plurality of antenna elements is an antipodal finline structure.

9. The apparatus of claim 1, wherein a bandwidth of each antenna element of the plurality of antenna elements is equal to or greater than a decade of frequency range.

10. The apparatus of claim 1, wherein each output port of the plurality of output ports is a connector selected from the group consisting of SMA, super SMA, type N, and type K connectors.

11. A passive coaxial signal power splitter apparatus comprising:

an input port;

an input coaxial waveguide section coupled to the input port;

a guided wave structure coupled to the input coaxial waveguide section;

a plurality of antenna elements arranged in the guided wave structure; and a plurality of output ports, wherein each output port is coupled to only one of the antenna elements and more than one output port is coupled to one antenna element of the plurality of antenna elements.

12. A passive coaxial signal power combining apparatus comprising:

a plurality of input ports;

a guided wave structure coupled to the plurality of input ports and having an inner radius and an outer radius;

a plurality of antenna elements arranged in a radial direction from the inner radius to the outer radius of the guided wave structure, wherein each of the antenna elements is coupled to only one input port of the plurality of input ports;

an output coaxial waveguide section coupled to the guided wave structure; and an output port coupled to the output coaxial waveguide section.

13. The apparatus of claim 12, wherein each antenna element of the plurality of antenna elements is configured to transform an electrical signal from an input port to an EM wave having an electric field with a substantially radial direction.

14. The apparatus of claim 12, wherein the input ports are arranged on an input plate and the input plate is coupled to the guided wave structure.

15. The apparatus of claim 12, wherein the input ports are arranged on the on the outer surface of the guided wave structure and is coupled to one of the antenna elements.

16. The apparatus of claim 12, wherein each antenna element of the plurality of antenna elements is an antipodal finline structure.

17. The apparatus of claim 12, wherein a bandwidth of each antenna element of the plurality of antenna elements is equal to or greater than a decade of frequency range.

18. The apparatus of claim 12, wherein each input port of the plurality of input ports is a connector selected from the group consisting of SMA, super SMA, type N, and type K connectors.

* * * * *

UNITED STATES PATENT AND TRADEMARK OFFICE

CERTIFICATE OF CORRECTION

PATENT NO. : 9,287,605 B2
APPLICATION NO. : 13/719167
DATED : March 15, 2016
INVENTOR(S) : Paul Daughenbaugh et al.

It is certified that error appears in the above-identified patent and that said Letters Patent is hereby corrected as shown below:

In the Specification:

In column 3, line 51, replace “angle a” with --angle α--.

In the Claims:

In column 8, line 19, replace “on the on the” with --on the--.

Signed and Sealed this
Twenty-fourth Day of May, 2016

Michelle K. Lee

Michelle K. Lee
*Director of the United States Patent and Trademark Office*